US005575583A

United States Patent [19]

Grembowicz et al.

[11] Patent Number: 5,575,583

[45] Date of Patent: Nov. 19, 1996

[54] APPARATUS AND METHOD FOR CONTROLLING THE MATERIAL FEED SYSTEM OF A PAVER

[75] Inventors: Conrad G. Grembowicz, Peoria; Keith R. Schmidt, Sycamore; Alan L. Ferguson, Peoria, all of Ill.

[73] Assignee: Caterpillar Paving Products Inc., Minneapolis, Minn.

[21] Appl. No.: 421,821

[22] Filed: Apr. 13, 1995

[51] Int. Cl.[6] ..... E01L 19/00

[52] U.S. Cl. ..... 404/72; 404/84.1

[58] Field of Search ..... 404/84.1, 84.5, 404/72

[56] References Cited

U.S. PATENT DOCUMENTS

| | | | |
|---|---|---|---|
| 3,743,432 | 7/1973 | Lee | 404/84.1 |
| 4,948,292 | 8/1990 | Haven et al. | 404/84 |
| 5,044,820 | 9/1991 | Prang | 404/84.1 |
| 5,232,305 | 8/1993 | Bassett et al. | 404/101 |
| 5,362,176 | 11/1994 | Sovik | 404/84.5 X |

*Primary Examiner*—William P. Neuder

*Attorney, Agent, or Firm*—David M. Masterson; Mario J. Donato

[57] ABSTRACT

An apparatus for controlling a material feed system of a paver is disclosed. The material feed system includes a feeder conveyor and a spreader auger. The apparatus includes a sensor that monitors the amount of material at the edge of the screed and responsively produces an actual material height signal. A rotary switch produces a desired material height signal indicative of a desired amount of material at the edge of the screed. A controller receives the actual and desired material height signals, determines a desired rotational speed of the auger in response to the difference between the signal magnitudes, and produces a command signal to rotate the auger at the desired speed. An electrohydraulic system receives the command signal and rotates the auger at the desired rotational speed.

18 Claims, 7 Drawing Sheets

APPARATUS AND METHOD FOR CONTROLLING THE MATERIAL FEED SYSTEM OF A PAVER

TECHNICAL FIELD

This invention relates generally to an apparatus and method for controlling the material feed system of a paver.

BACKGROUND ART

Typically, floating screed pavers comprise a self-propelled paving machine having a hopper at its forward end for receiving material from a dump truck pushed along the roadbed by the paver. The truck progressively dumps its load of paving material into the hopper.

A conveyor system on the paver transfers the paving material from the paver hopper for discharge on the roadbed. Screw augers then spread the material on the roadbed in front of the main screed. The screed is commonly connected to the paving machine by pivoting tow or draft arms. Accordingly, the screed is commonly referred to as a "floating screed".

Typically, the rotation of the augers and conveyors are controlled by a common source, which maintains the rotational speed ratio of the augers to the conveyors in a fixed relationship. In order to vary the rate of material that is carried by the conveyors relative to the rate of material carried by the augers, gates are placed in front of the conveyor system to limit the height of the material. Unfortunately, the gates are manually adjusted making it difficult to maintain a uniform depth of material that is deposited by the conveyor system.

Thus, there is a need to provide for independent control over the conveyor and auger to achieve a uniform depth of material. Accordingly, the present invention is directed to overcoming one or more of the problems as set forth above.

DISCLOSURE OF THE INVENTION

In one aspect of the present invention, an apparatus for controlling a material feed system of a paver is disclosed. The material feed system includes a feeder conveyor and a spreader auger. The apparatus includes a sensor that monitors the amount of material adjacent the screed and responsively produces an actual material height signal. A rotary switch produces a desired material height signal indicative of a desired amount of material adjacent the screed. A controller receives the actual and desired material height signals, determines a desired rotational speed of the auger in response to the difference between the signal magnitudes, and produces a command signal to rotate the auger at the desired speed. An electrohydraulic system receives the command signal and rotates the auger at the desired rotational speed.

BRIEF DESCRIPTION OF THE DRAWINGS

For a better understanding of the present invention, reference may be made to the accompanying drawings in which.

BEST MODE FOR CARRYING OUT THE INVENTION

Figure 1:
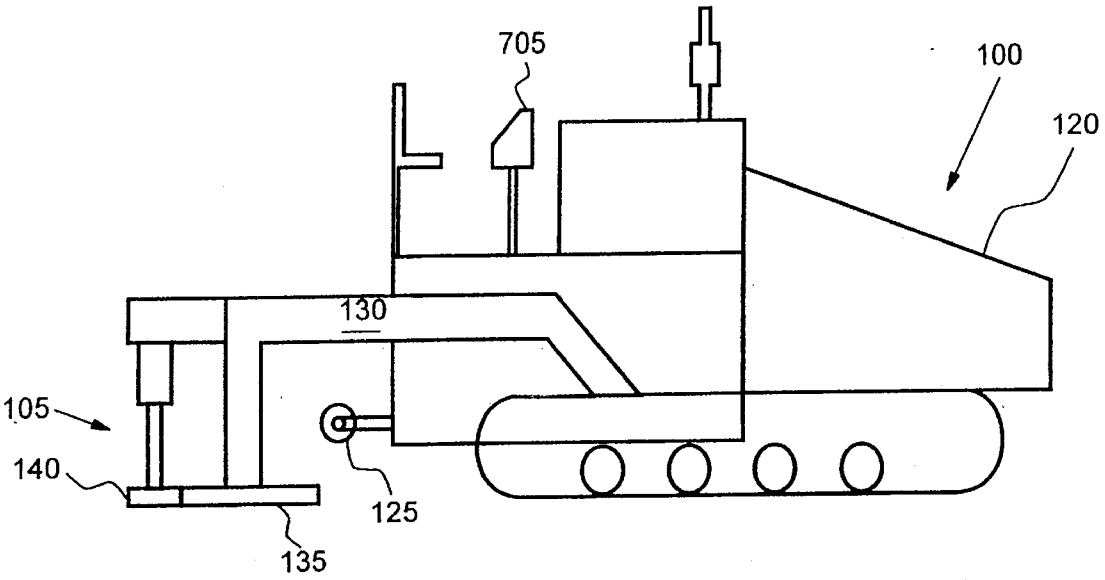
FIG. 1 is a planer side view of an asphalt paver.
Figure 2:
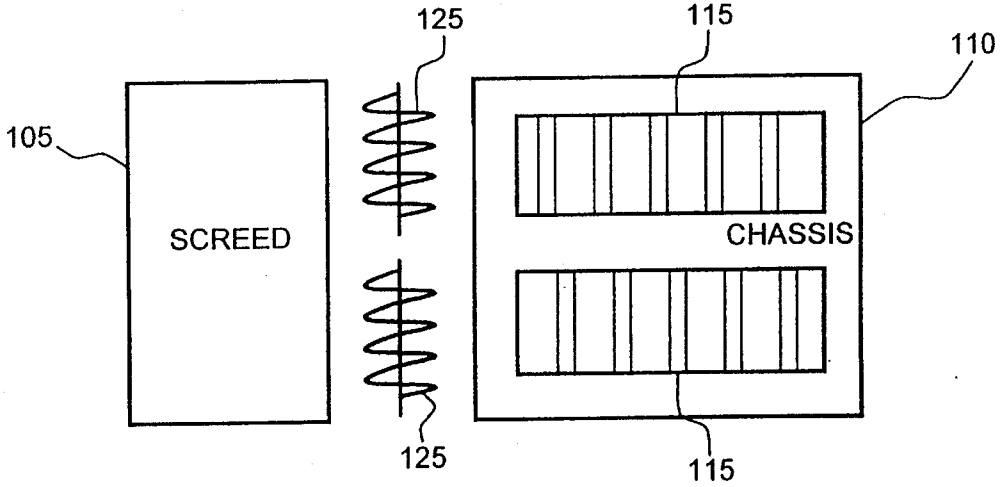
FIG. 2 is a planer top view of the asphalt paver.

Referring now to the drawings, FIGS. 1 and 2 illustrate a paver 100. FIG. 1 shows a side view of the paver 100, while FIG. 2 shows a top view of the paver 100. The paver 100 may be of the rubber tire or crawler track type and includes a floating screed assembly 105. The paver 100 has a chassis 110 through which dual feed conveyors 115 carry paving material, such as asphalt material, from a feed hopper 120 located at the front of the paver 100. Spreader augers 125, also referred to as spreading screws, are disposed transversely to and at the rear of the chassis 110. The augers 125 distribute the asphalt material transversely to the direction of travel of the paver 100. For example, rotating in one direction, the augers 125 carry material "out" to the edge of the screed; and rotating in another direction, the augers carry material "in" to the center of the screed. The material is spread over the desired width of a strip of pavement. The thickness and width of the pavement is established by the material-compacting, screed assembly 105. As shown, the screed assembly 105 is attached to the chassis 110 by a pair of draft arms 130. Preferably, the screed assembly 105 includes a main screed 135 and an extendable screed 140. The main screed 135 is formed in two sections, one on each side of the center line of the paver. Consequently, an extension screed 140 is mounted to each of the main screed sections.

Figure 3:
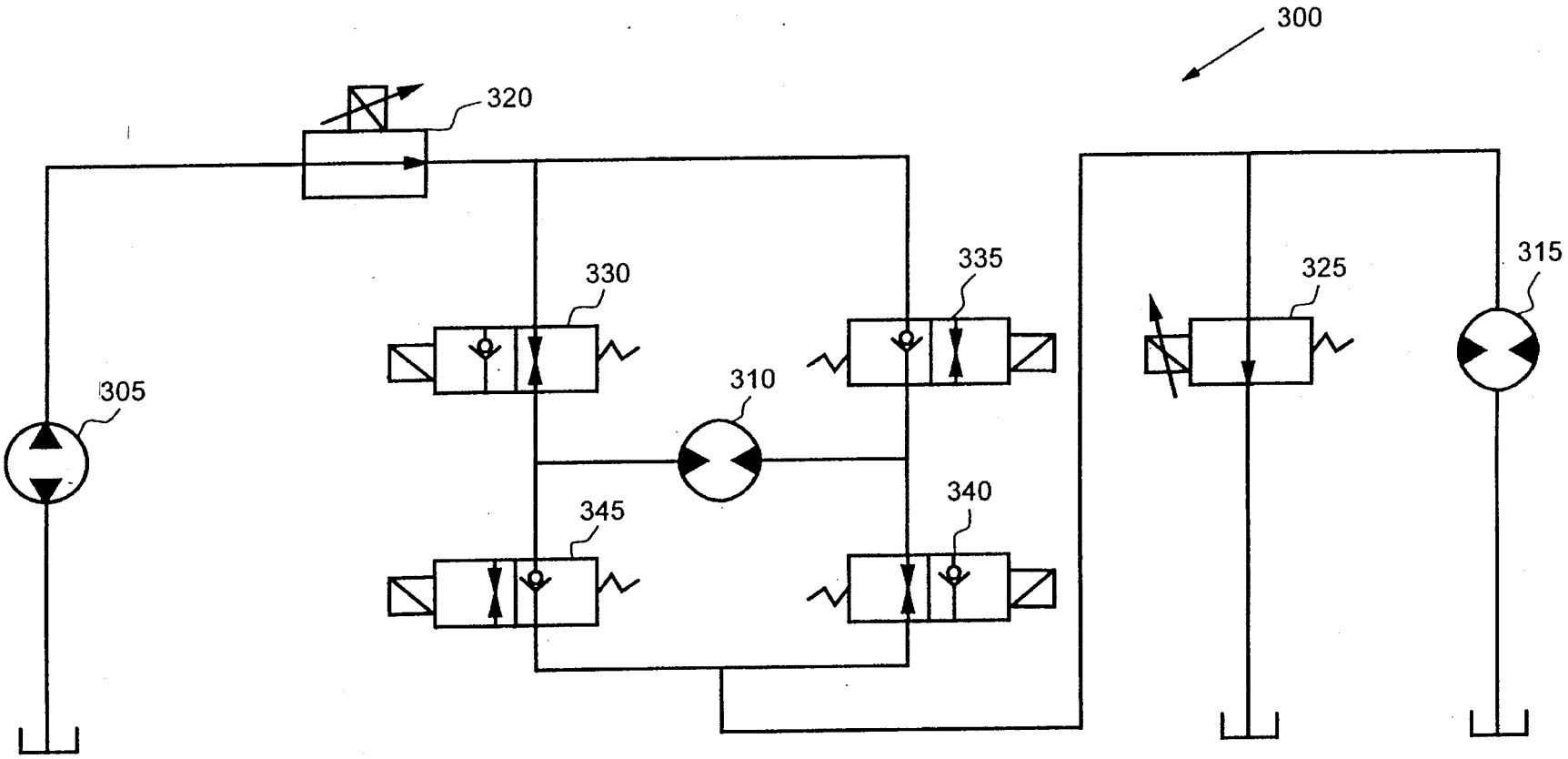
FIG. 3 is an hydraulic schematic of a material feed system associated with the present invention.

The material feed system consists of left and right independent systems which are identical. The electrohydraulic structure of the right hand material feed system 300 is shown with reference to FIG. 3. A hydraulic pump 305 supplies pressurized hydraulic fluid to an auger motor 310 and a conveyor motor 315. Fluid flow to the auger and conveyor motors 310,315 are regulated via a solenoid actuated flow valve 320. Fluid flow to the conveyor motor 315 is further regulated by a solenoid actuated flow valve 325. A set of solenoid actuated ON/OFF valves 330,335,340,345 are plumbed across the auger motor 310 to provide for forward and reverse rotation of the auger motor, and to provide a means for fluid flow to bypass the auger motor 310. For example, controlling the flow of fluid through valves 330, 340 provides for forward rotation of the auger motor 310, and controlling the flow of fluid through valves 330,335, 340,345 provide for reverse rotation of the auger motor 310. Additionally, controlling the flow of fluid through valves 335,345 provides for fluid to bypass the auger motor 310. Note that, the left hand material feed system will have identical components. Further, although pump 305 and motor 315 are shown as fixed displacement type hydraulic elements, it will be apparent to those skilled in the art that such hydraulic elements may equally be variable displacement hydraulic elements, which would eliminate the need for valves 320,325.

Figure 4:
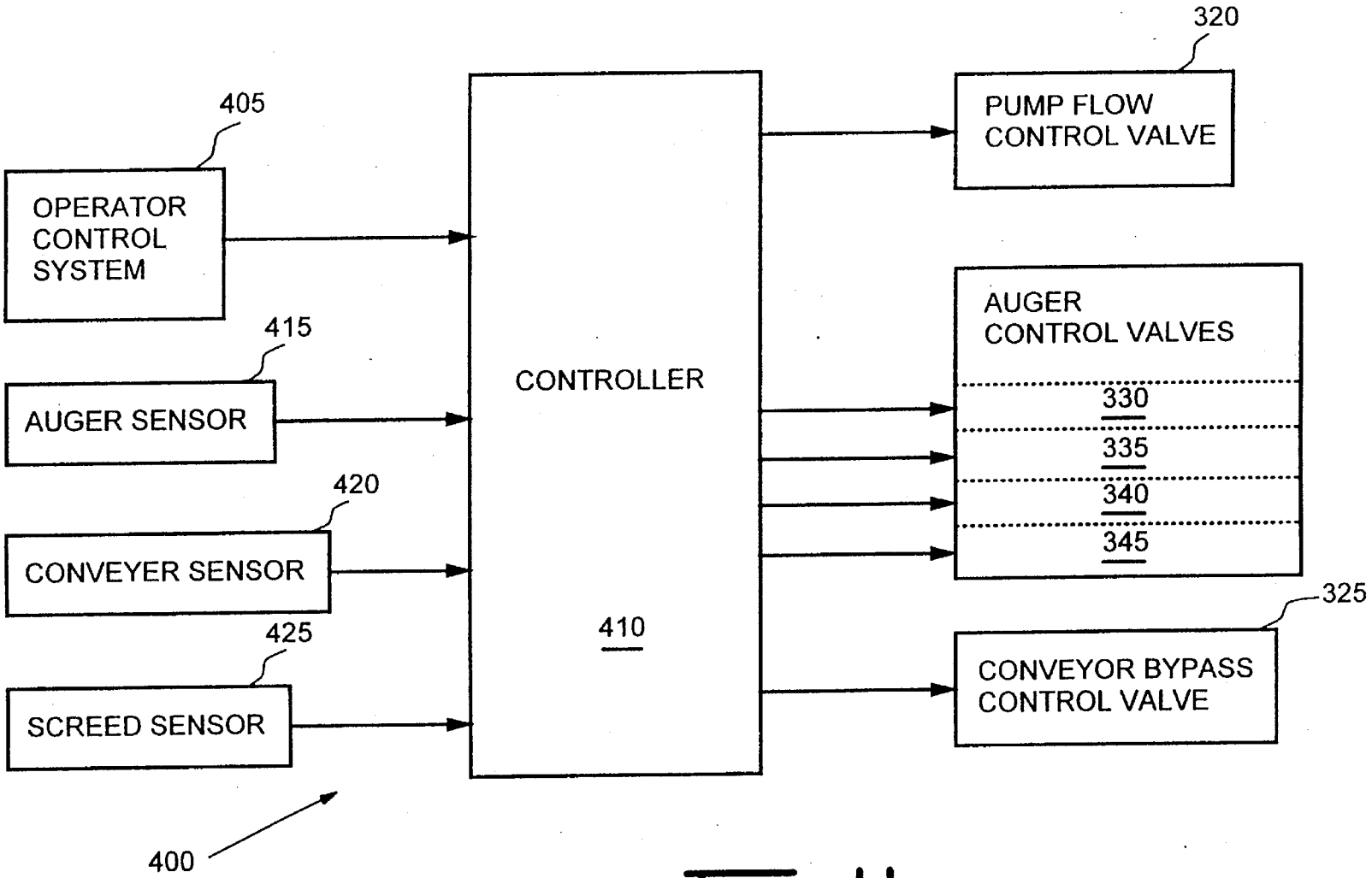
FIG. 4 is a block diagram of an electronic control system associated with the present invention.

Referring now to FIG. 4, a block diagram of an electronic control system 400 of the present invention is shown.

Illustrated is the control for the right hand material feed system, for example. An operator control system 405 provides for operator control over the conveyor and auger speeds, as well as, the directional rotation of the auger. Accordingly, the operator control system 405 produces operator control signals that are received by a controller 410. The controller 410 is a microprocessor based system that receives the operator control signals and produces command signals that are received by the electrohydraulic control valves 320,325,330,335,340,345. The controller 410 additionally receives signals produced by an auger sensor 415, which monitors the amount of material near the edge of the screed. Finally, the controller may receive signals produced by a conveyer sensor 420, which monitors the amount of material deposited by the conveyer 115; or signals produced by a screed position sensor 425, which monitors the linear position or extension of the screed extension 140. Note that, the left hand material feed systems is controlled in an identical manner.

Figure 5:
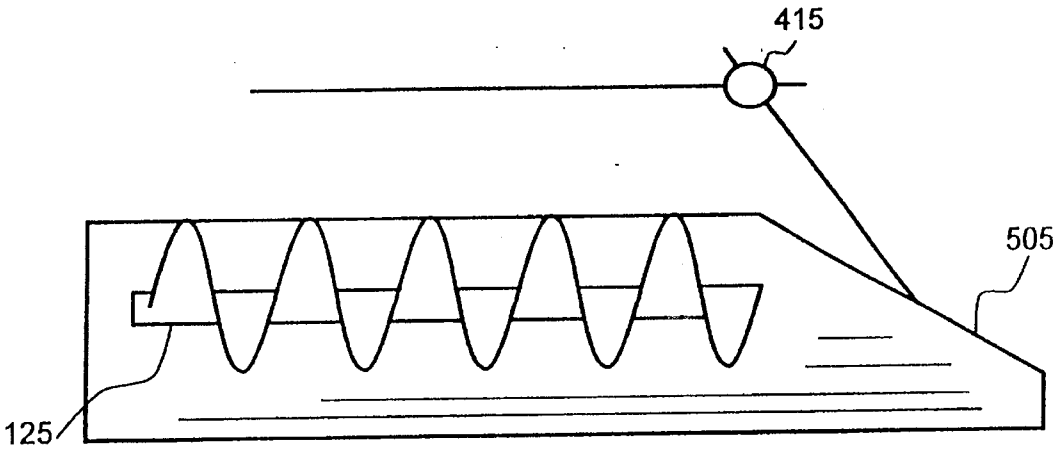
FIG. 5 illustrates an auger sensor.

Reference is now made to FIG. 5 to illustrate the auger sensor 415. The auger sensor 415 monitors the amount of material 505 near the edge of the extension screed and produces an actual material height signal that is indicative of the height of material near the edge of the extension screed. As shown, the auger sensor 415 may include a paddle type construction. Such a sensor construction consists of a potentiometer or other sensing device that produces a signal having a magnitude that is proportional to the angle of the paddle. Such paddle sensors are well known in the art. Thus, the controller 410 receives the actual material height signal and calculates the linear height of material based on the sensor angle. For example, the controller 410 may include a software look-up table that contains various material heights that are associated with various paddle angles. Alternatively, the auger sensor may include an ultrasonic sensor that produces a signal magnitude that is directly related to the material height.

Figure 6:
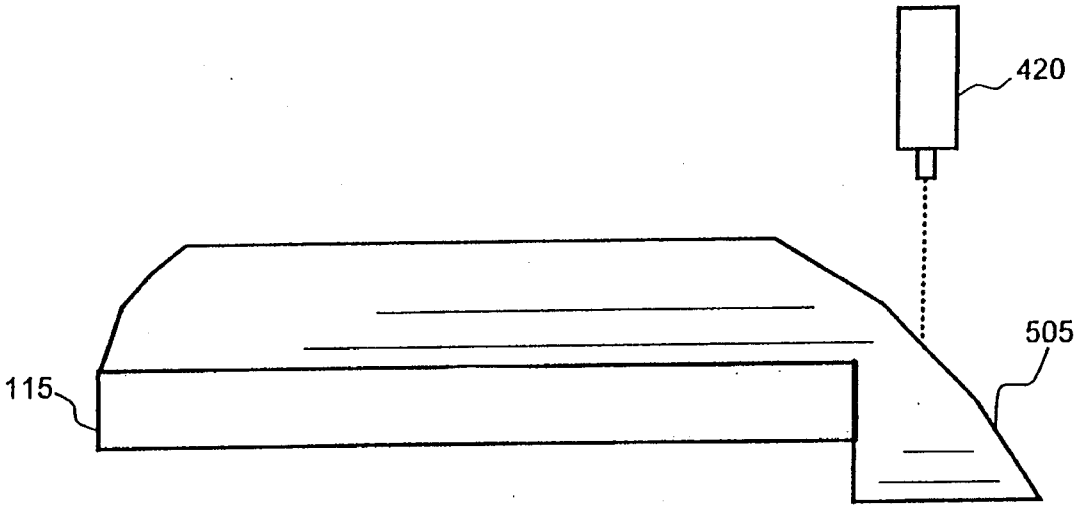
FIG. 6 illustrates a conveyor sensor.

Reference is now made to FIG. 6 to illustrate the conveyor sensor 420. The conveyor sensor 420 produces a conveyor material sensing signal that is indicative of the amount of material deposited by the conveyor. The conveyor sensor may include an ultrasonic sensor that produces a signal magnitude that is directly related to the height of material deposited by the conveyor.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

Figure 7:
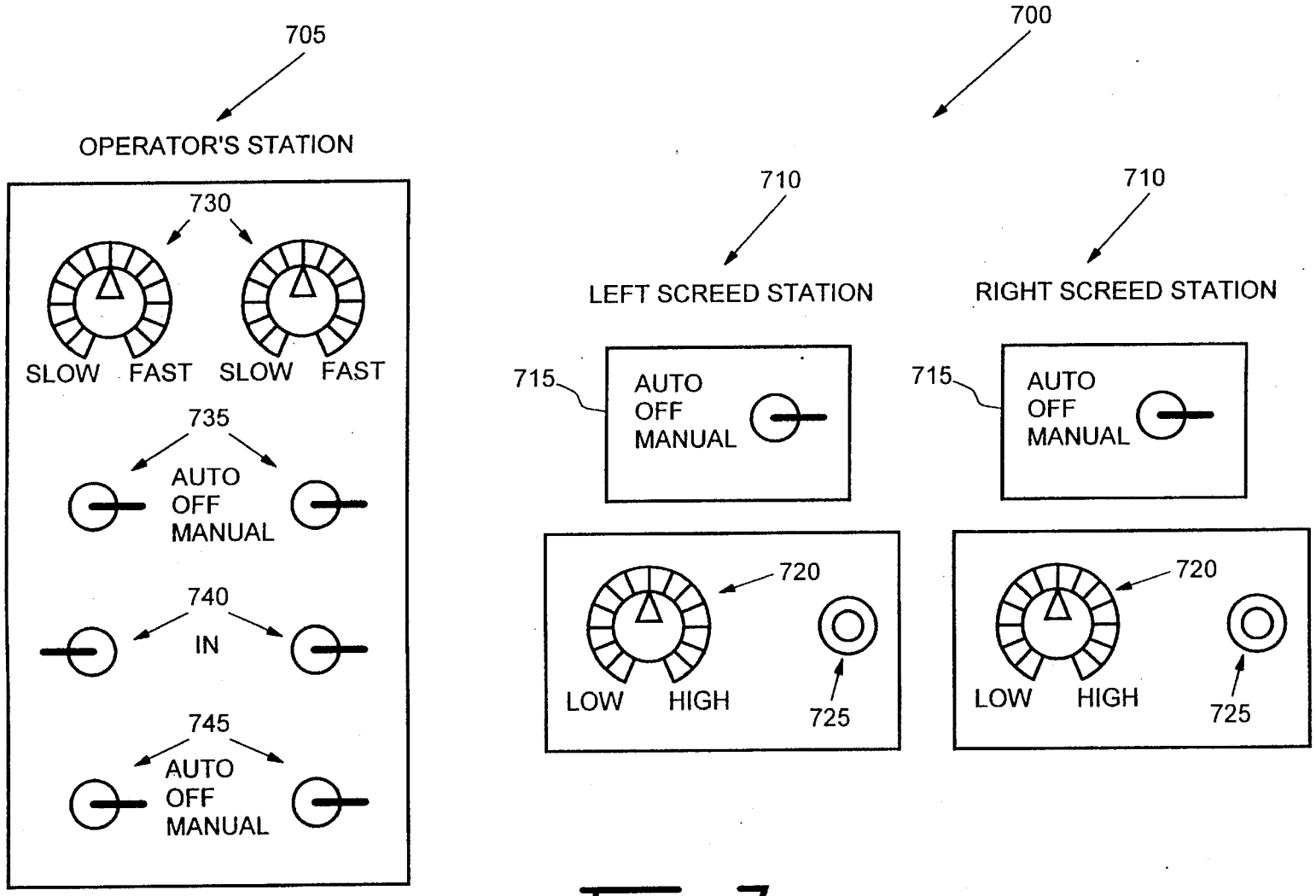
FIG. 7 illustrates an operator control panel.

The operation of the present invention is now described to illustrate its features and advantages. Referring now to FIG. 7, the operator control system 700 is shown. Control over the material feed system is typically exercised from an operator's station 705, which is located at the rear of the machine; and a pair of screed stations 710, which are typically located on the right and left side of the screed. The screed stations 710 are used by a ground person or screed operator. As will be described below, the present invention provides for independent and automatic control of the conveyor and auger motors.

First, the screed station 710 will be discussed. As shown, the right and left material feed systems have independent control. A feeder system mode switch 715 is used to control both the auger and conveyor functions. For example, the switch 715 is positionable to three positions: "off", which stops both the auger and conveyor rotation; "auto", which enables automatic operation of the auger and conveyor speed; and "manual", which controls the auger and conveyor at a predetermined speed. A material height dial 720 is used to set the desired height of material at the edge of the screed. Accordingly, the material height dial 720 produces a desired material height signal indicative of a desired amount of asphalt material at the edge of the screed. The magnitude of the material height signal is adjusted by the relative position of the dial. For example, "low" represents a desired minimum amount of material, while "high" represents a desired maximum amount of material at the end of the screed. An auger reverse switch 725 is used to momentarily reverse the auger rotation.

Now, the operator station 705 will be discussed. As shown, the right and left material feed systems have independent control. In one embodiment, a conveyor ratio dial 730 is used to set the desired ratio of the conveyor speed to the auger speed. Accordingly, the conveyor ratio dial 730 produces a desired conveyor ratio signal indicative of a desired speed ratio of the auger to the conveyor. The magnitude of the desired conveyor ratio signal is adjusted by the relative position of the conveyor ratio dial 730. For example, "slow" represents a minimum speed ratio of the conveyor speed to the auger speed, while "fast" represents a maximum speed ratio of the conveyor speed to the auger speed. Thus, the conveyor speed is calculated as a percent of the auger speed. A conveyor mode switch 735 is used to set a special conveyor mode. The switch 735 is positionable to three positions: "off", which stops the conveyor rotation; "auto", which enables automatic control of the conveyor speed; and "manual", which controls the conveyor at a predetermined speed. An auger reverse switch 740 is used to set the desired rotation of the auger 125. Finally, an auger mode switch 745 is used to set a special auger mode. The switch 745 is positionable to three positions: "off", which stops the auger rotation; "auto", which enables automatic operation of the auger speed; and "manual", which controls the auger at a predetermined speed.

Note, the conveyor and auger mode switches 735,745 operate independently to each other. Also, the feeder system mode switch 715 has higher priority than the conveyor and auger mode switches 735,745. Thus, the conveyor and auger mode switches 735,745 can only control the operation of the conveyor and auger speeds when the feeder system mode switch 715 is set to a position other than the "off" position. Moreover, automatic control of the conveyor or auger can only occur with the feeder system mode switch 715 set to the "auto" mode and both the conveyor and auger mode switches 735,745 set to the "auto" mode.

Figure 8:
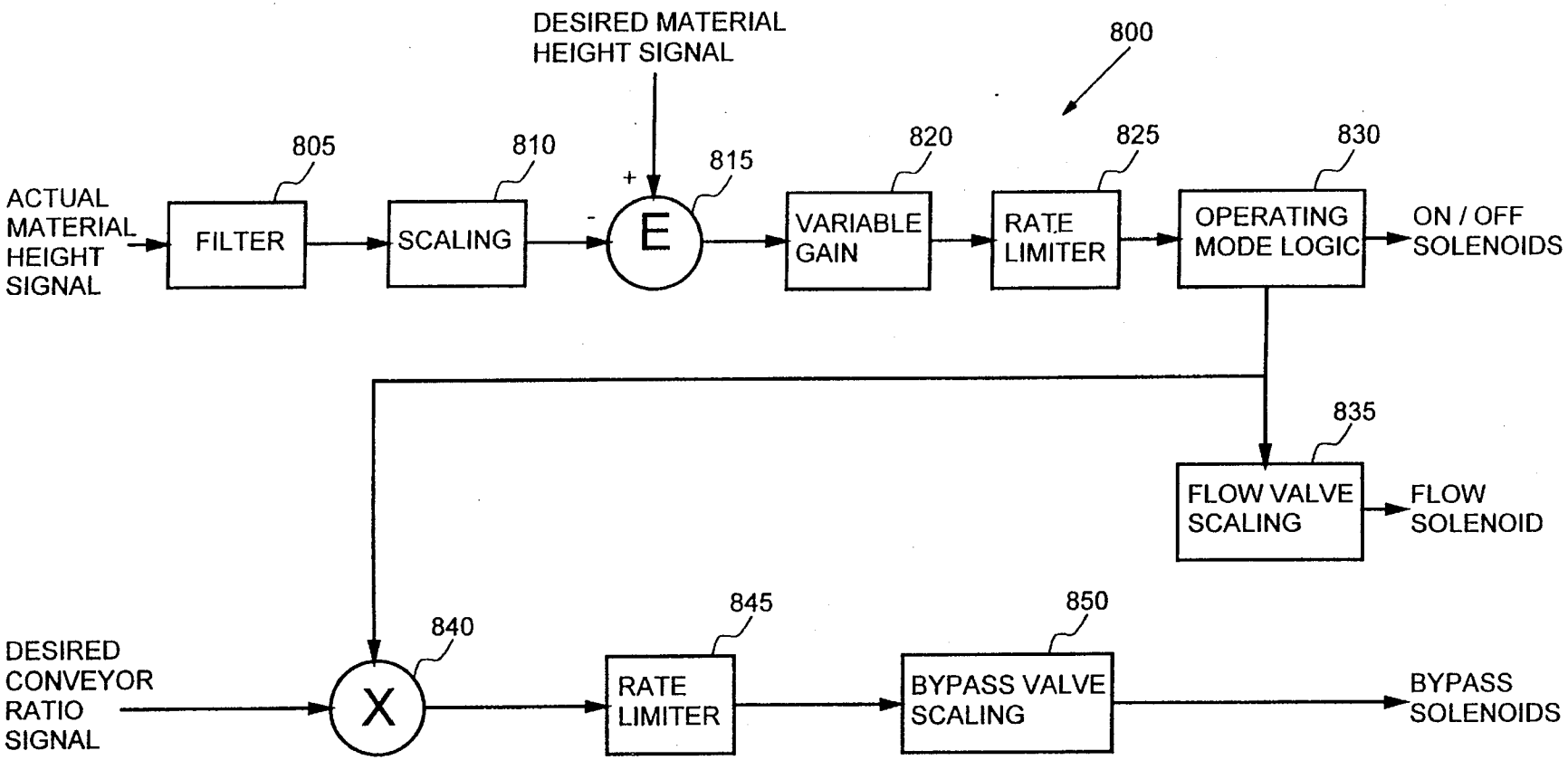
FIG. 8 is a block diagram of one embodiment of an automatic control of the material feed system associated with the present invention.

A high level block diagram of one embodiment of an automatic control 800 is shown with respect to FIG. 8. Illustrated is the control for the right hand material feed system, for example. First, at block 805, the controller 410 receives the actual material height signal and performs a filtering operation to remove any spurious waveforms. If needed, the filtered signal is then scaled to correspond to linear measurement, at block 810. For example, if a paddle type sensor is used, the control translates the rotational information to linear information to indicate the height of the asphalt material near the edge of the screed. The scaled signal is delivered to summing block 815, along with the desired material height signal, and the control determines the difference between the signal magnitudes, and produces an error signal. The error signal is delivered to a variable gain block 820 which multiplies the error signal by one or more variable gain values. For example, the variable gain block 820 may include well known PID control algorithms. The variable gain block 820 produces an auger control signal, which is limited by a rate limiter block 825 to create a smooth transition to the controlled values. Then, at block 830, the control reads the various positions of the mode switches 715,735,745 and rotation direction switches 725, 740 located at the operator and screed stations 705,710. Assuming that the feeder mode and the auger mode switches 715,735,745 are set to the "auto" position, the control calculates the required current to modulate the pump flow control valve 320 in order to rotate the auger motor 310 at a desired speed that reduces the error signal to zero, and responsively delivers an auger command signal to the pump flow control valve 320, at block 835.

Thus, the control increases the auger rotational speed in response to the actual material height signal magnitude being less than the desired material height signal magnitude, i.e., the amount of asphalt material near the edge of the screed being below that of the desired amount of material. Alternately, the control reduces the auger rotational speed in response to the actual material height signal magnitude being greater than the desired material height signal magnitude, i.e., the amount of asphalt material near the edge of the screed being greater than that of the desired amount of material.

Assuming that the conveyor mode switch is set to the "auto" position, control proceeds to a multiplication block 840, which multiplies the desired conveyor ratio signal with the auger control signal, and produces a conveyor control signal. The conveyor control signal is limited by a rate limiter block 845. Finally, the control calculates the required current to modulate the conveyor bypass valve 325 in order to control the rotation of the conveyor motor 315 at the desired speed ratio, and responsively delivers a conveyor command signal to the conveyor bypass valve 325, at block 850.

Additionally, the speed of the conveyor may be controlled in response to the paving width. For example, multiplication block 840 may additionally receive a screed position signal produced by the screed sensor 425, where the screed position signal is indicative of the paving width. Accordingly, as the paving width increases, the control proportionally decreases the speed of the conveyor to account for the additional amount material that will be carried by the auger. For example, as the paving width becomes larger, the auger must carry a greater amount of material to the edge of the screed. Consequently, the control slows the rotational speed of the conveyer in response to increasing paving width in order to decrease the rate of material deposited by the conveyor so that the auger can operate more effectively.

Figure 9:
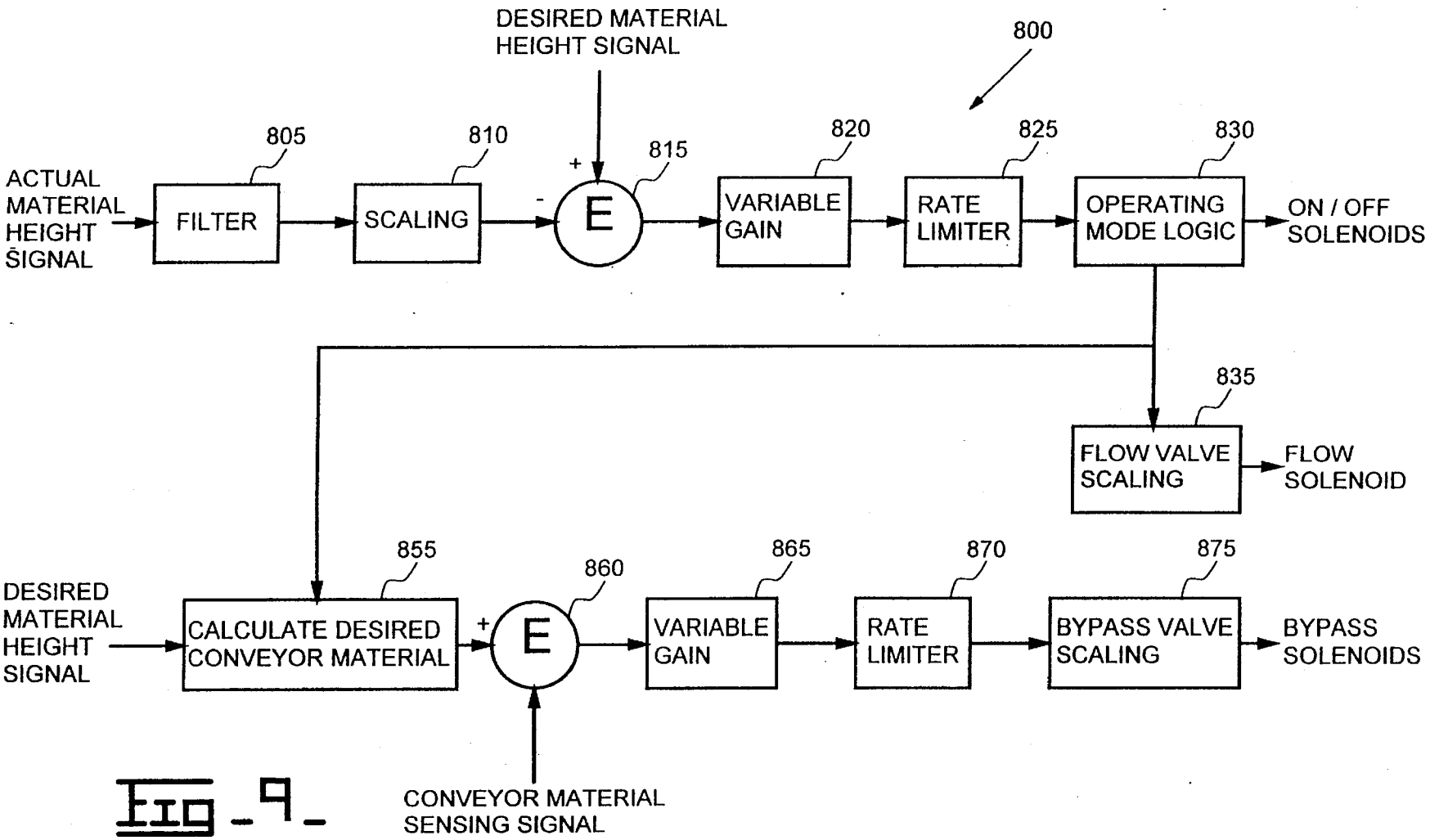
FIG. 9 is a block diagram of another embodiment of the automatic control of the material feed system associated with the present invention.

A high level block diagram of an alternate embodiment of the automatic control 800 is shown with respect to FIG. 9. In the alternate embodiment, a conveyor sensor, which was described with reference to FIG. 6, is used to automatically control the rotational speed of the conveyor. The conveyor sensor 420 replaces the conveyor ratio dial 730. Referring to block 855, the control receives the desired conveyor material height signal, as well as, the auger control signal calculates the desired amount of material that is to be deposited by the conveyor, and produces a desired conveyor material signal. The desired conveyor material signal is delivered to summing block 860, along with the conveyor material sensing signal. The summing block 860 determines the difference between the signal magnitudes, and produces an error signal. The error signal is delivered to a variable gain block 865 which multiplies the error signal by one or more variable gain values. The variable gain block 865 produces a conveyor control signal, which is limited by a rate limiter block 870. Finally, the control calculates the required current to modulate the bypass control valve 325 in order to rotate the conveyor motor 315 at a desired speed that reduces the error signal to zero.

Thus, the control increases the conveyor rotational speed in response to the conveyor material sensing signal magnitude being less than the desired conveyor material height signal magnitude, i.e., the amount of asphalt material being deposited by the conveyor is below that of the desired amount. Alternately, the control reduces the conveyor rotational speed in response to the conveyor material sensing signal magnitude being greater than the desired material height signal magnitude, i.e., the amount of asphalt material being deposited by the conveyor is greater than that of the desired amount.

Finally, because the control monitors the amount of material at the edge of the screed and the amount of material deposited by the conveyor, any change in paving width is automatically compensated by the control to achieve the desired material height.

Other aspects, objects and advantages of the present invention can be obtained from a study of the drawings, the disclosure and the appended claims.

We claim:

1. An apparatus for controlling a material feed system of a paver having a screed, the material feed system including a feeder conveyor and a spreader auger, the apparatus comprising:

means for monitoring the amount of material adjacent the screed and responsively producing an actual material height signal;

means for producing a desired material height signal indicative of a desired amount of material adjacent the screed;

means for receiving the actual and desired material height signals, determining a desired rotational speed of the auger in response to the difference between the signal magnitudes, and producing a command signal to rotate the auger at the desired speed; and means for receiving the command signal and rotating the auger at the desired rotational speed.

2. An apparatus, as set forth in claim 1, including means for producing a desired conveyor ratio signal indicative of a desired speed ratio between the auger speed and the conveyor speed.

3. An apparatus, as set forth in claim 2, wherein the command signal producing means includes means for receiving the desired conveyor ratio signal, and producing a command signal to rotate the conveyor at the desired speed ratio.

4. An apparatus, as set forth in claim 3, including means for sensing the linear extension of the screed and producing a screed sensing signal.

5. An apparatus, as set forth in claim 4, wherein the command signal producing means includes means for receiving the desired conveyor ratio signal, the screed sensing signal, and producing a command signal to rotate the conveyor in response to the desired conveyor ratio signal and the screed sensing signal.

6. An apparatus, as set forth in claim 1, including means for monitoring the amount of material deposited by the conveyor and responsively producing a conveyor material sensing signal.

7. An apparatus, as set forth in claim 6, including means for producing a desired conveyor material signal indicative of a desired amount of material to be deposited by the conveyor.

8. An apparatus, as set forth in claim 7, including means for receiving the conveyor material sensing signal and the desired conveyor material signal, determining a desired rotational speed of the conveyor in response to the difference between the signal magnitudes, and producing a command signal to rotate the conveyor at the desired rotational speed.

9. An apparatus, as set forth in claim 1, including:

a hydraulic pump for producing pressured fluid;

a hydraulic motor associated with the conveyor for receiving the pressurized fluid and rotating the conveyor; and a hydraulic motor associated with the auger for receiving the pressurized fluid and rotating the auger pair.

10. An apparatus, as set forth in claim 9, wherein the electrohydraulic means further includes:

a pump flow valve plumbed in series with the auger and conveyor motors for receiving the auger command signals, the auger command signals modulating the pump flow valve to rotate the associated auger at the desired speed; and a conveyor bypass valve plumbed in parallel with the conveyor motor for receiving the conveyor command signals, the conveyor command signals modulating the bypass valve to rotate the conveyor at the desired speed.

11. A method for controlling a material feed system of a paver having a screed, the material feed system including a feeder conveyor and a spreader auger, the method comprising the steps of:

producing an actual material height signal indicative of the material height at the edge of the screed;

producing a desired material height signal indicative of a desired amount of material at the edge of the screed;

receiving the actual and desired material height signals, determining a desired rotational speed of the auger in response to the difference between the signal magnitudes, and producing a command signal to rotate the auger at the desired speed; and receiving the command signal and rotating the auger at the desired rotational speed.

12. A method, as set forth in claim 11, including the step of producing a desired conveyor ratio signal indicative of a desired speed ratio between the auger speed and the conveyor speed.

13. A method, as set forth in claim 12, including the steps of receiving the desired conveyor ratio signal, and producing a command signal to rotate the conveyor at the desired speed ratio.

14. A method, as set forth in claim 13, including the steps of producing a screed sensing signal indicative of the paving width.

15. A method, as set forth in claim 14, including the steps of receiving the desired conveyor ratio signal, the screed sensing signal, and producing a command signal to rotate the conveyor in response to the desired conveyor ratio signal and the screed sensing signal.

16. A method, as set forth in claim 11, including the step of producing a conveyor material sensing signal indicative of the amount of material deposited by the conveyor.

17. A method, as set forth in claim 16, including the step of producing a desired conveyor material signal indicative of a desired amount of material to be deposited by the conveyor.

18. A method, as set forth in claim 17, including the steps of receiving the conveyor material sensing signal and the desired conveyor material signal, determining a desired rotational speed of the conveyor in response to the difference between the signal magnitudes, and producing a command signal to rotate the conveyor at the desired rotational speed.

* * * * *